US006848938B2

(12) United States Patent
Miyamoto

(10) Patent No.: US 6,848,938 B2
(45) Date of Patent: Feb. 1, 2005

(54) PANEL-MOUNTABLE PART AND METHOD OF DISMOUNTING SUCH A PANEL-MOUNTABLE PART

(75) Inventor: Toshifumi Miyamoto, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/452,214

(22) Filed: May 30, 2003

(65) Prior Publication Data

US 2004/0242063 A1 Dec. 2, 2004

(30) Foreign Application Priority Data

May 30, 2002 (JP) ..... 2002-157852

(51) Int. Cl.[7] ..... H01R 13/73
(52) U.S. Cl. ..... 439/557; 439/556
(58) Field of Search ..... 439/562, 556, 439/557, 544, 548, 549, 550

(56) References Cited

U.S. PATENT DOCUMENTS 5,044,986 A * 9/1991 Baumanis ..... 439/548
5,249,982 A * 10/1993 Funck et al. ..... 439/556
5,545,061 A * 8/1996 Sawayanagi ..... 439/752
5,660,564 A * 8/1997 Yamanashi et al. ..... 439/557

FOREIGN PATENT DOCUMENTS

JP 6-72183 10/1994

* cited by examiner

*Primary Examiner*—Neil Abrams
(74) *Attorney, Agent, or Firm*—Gerald E. Hespos; Anthony J. Casella

(57) ABSTRACT

A grommet (40) is externally attached to a connector holder (20) mountable on a panel (P) while being introduced through a mount hole (H) in the panel (P). The connector holder (20) has a flange (34) for holding the grommet (40), and includes lock arms (32) for holding the connector holder (20) on the panel (P) by engaging the front edge of the mount hole (H). The lock arms (32) are inward from the flange (34). Operating notches (35) are formed in portions of the flange (34) corresponding to the lock arms (32). Thus, portions of the lock arms (32) projecting backward from the panel (P) can be operated from outside via is the grommet (40) to displace the lock arms (32) while disengaging them from the panel (P).

6 Claims, 11 Drawing Sheets

PANEL-MOUNTABLE PART AND METHOD OF DISMOUNTING SUCH A PANEL-MOUNTABLE PART

BACKGROUND OF THE INVENTION

1. Field of the Invention

The invention relates to a panel-mountable part, such as a connector holder or connector, and to a method of dismounting such a panel-mountable part.

2. Description of the Related Art

Japanese Utility Model Publication No. 6-72183 and FIG. 11 herein disclose a panel-mountable part to be introduced through a mount hole formed in a panel for mounting on the panel. With reference to FIG. 11, a connector 1 is mountable to a panel 2. The connector 1 has a pair of connector housings 1*a*, 1*b* provided at ends of wires and connectable with each other. The panel 2 is formed with a mount hole 2*a* and a connector holder 3 is mountable into the mount hole 2*a* while accommodating the connector 1. A grommet 4 is attached to cover a portion of the connector holder 3 projecting backward with respect to the mounting direction from the mount hole 2*a* of the panel 2. The grommet 4 is held in close sealing contact with the rear surface of the panel 2. A flange 3*a* is on the outer surface of the connector holder 3 for holding the grommet 4, and a lock arm 3*b* is provided inward of the flange 3*a* for holding the connector holder 3 on the panel 2 by engaging the front edge of the mount hole 2*a*.

The lock arm 3*b* has to be resiliently deformed to cancel its locking state if the connector holder 3 must be detached from the panel 2. However, operability has been poor since the grommet 4 between the flange 3*a* and the panel 2 needs to be detached to deform the lock arm 3*b*.

The invention was developed in view of the above and an object is to improve the detaching operability of a panel-mountable part from a panel.

SUMMARY OF THE INVENTION

The invention is directed to a panel-mountable part, such as a connector holder or a connector, introduced through a mount hole in the panel for mounting on the panel. A grommet is mountable onto the panel-mountable part to substantially cover a rear side of the panel-mountable part and is held in close sealing contact with the rear surface of the panel. At least one lock arm is resiliently engageable with the front edge of the mount hole. The lock arm can be displaced and disengaged from the panel by operating an operable portion that projects back from the panel. The operable portion can be operated by deforming the grommet and thus deforming the lock arm out of engagement from the front edge of the mount hole. Thus, it is possible to detach the panel-mountable part from the panel without dismounting the grommet beforehand.

The outer surface of the panel-mountable part preferably has a flange covered by the grommet. The flange is configured to hold the grommet. Thus, the grommet can be mounted easily to the panel-mountable part.

The lock arm preferably is inward from the flange, and the flange preferably has an operating notch for permitting the lock arm to be operated from outside via the grommet.

The lock arm resiliently engages the front edge of the mount hole when the panel-mountable part is mounted on the panel. Thus the grommet held by the flange is in close sealing contact with the rear surface of the panel.

The lock arm is displaced resiliently and disengaged from the panel by operating the portion of the grommet aligned with the operating notch. Thus, the grommet need not be detached during the detaching operation, and the detaching operability of the panel-mountable part from the panel can be improved.

The lock arm preferably comprises an operable portion extending more backward than the flange and operable from outside via the grommet.

The grommet may comprise an escaping portion for permitting escape of the operable portion. The operable portion may be operated by deforming the escaping portion. The escaping portion may be a projection of the grommet at a peripheral position aligned the operable portion.

At least one mark visible from outside may be provided on a portion of the grommet indicating the operating notch and/or the operable portion. The locking state of the lock arm can be canceled by operating the portion provided with the mark from outside. Thus, the detaching operability of the panel-mountable part from the panel can be improved.

The flange preferably can be positioned at such a longitudinal position that a pressing portion of the grommet can be squeezed between the flange and the panel.

The pressing portion preferably comprises projections provided over substantially the entire periphery and engageable with the panel.

The invention also relates to a method of dismounting a panel-mountable part, such as a connector holder or a connector, mounted through a mount hole in a panel. The panel-mountable part comprises a grommet attachable to the panel-mountable part to cover a rear side of the panel-mountable part and to closely contact with the rear surface of the panel. The method comprises operating at least one lock arm that engages the front edge of the mount hole to disengage the lock arm from the panel. The operating step comprises deforming the grommet and thereby deforming the lock arm.

The panel-mountable part preferably comprises a flange on at least part of the outer surface of a portion of the panel-mountable part covered by the grommet and the lock arm is operated from outside via the grommet by means of at least one operating notch formed in the flange.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A connector holder according to a first embodiment of the invention is identified by the numeral 20 in FIGS. 1 to 5. The connector holder 20 can be introduced through a mount hole H in a panel P for holding a connector 10 to the panel P. In the following description, a mounting direction MD (leftward in FIG. 3) of the connector holder 20 to the panel P is referred to as forward direction, and a direction (rightward in FIG. 3) substantially opposite from the mounting direction MD is referred to as backward direction.

Figure 3:
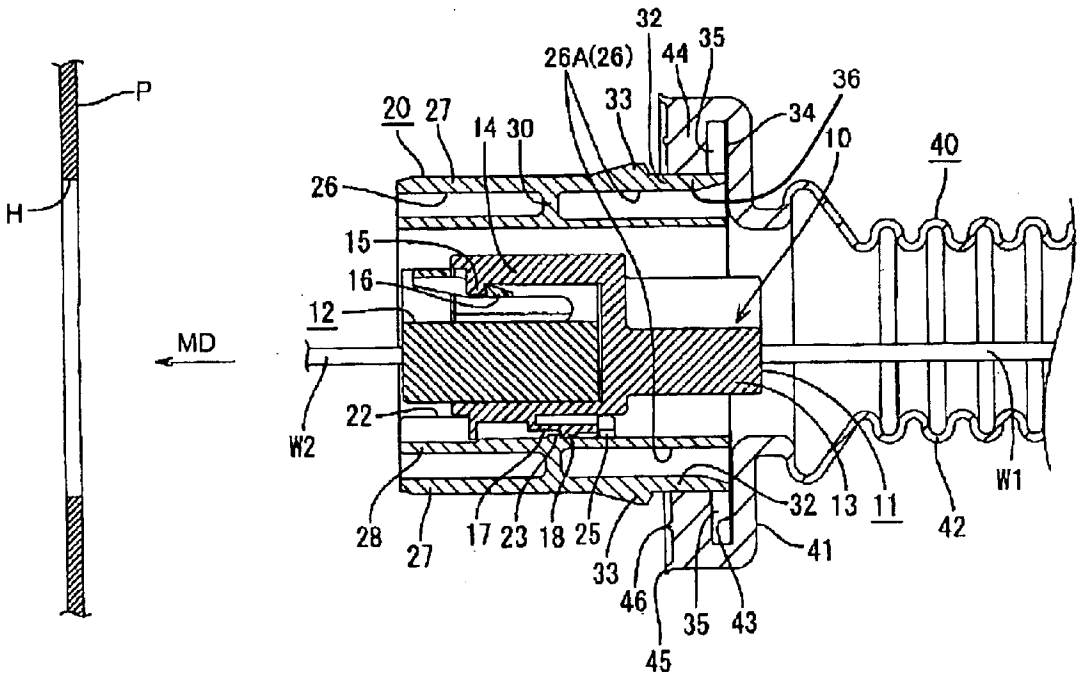
FIG. 3 is a longitudinal section showing a state before the connector holder accommodating a connector and having a grommet attached thereto is mounted on a panel.

The connector 10 is comprised of male and female housings 11, 12 that are connectable with each other, as shown in FIG. 3. The housings 11, 12 both are made e.g. of a synthetic resin. The male housing 11 includes a substantially block-shaped terminal accommodating portion 13 for accommodating at least one male terminal fitting (not shown) connected with an end of a wire W1, and a substantially tubular receptacle 14 projects forward from the terminal accommodating portion 13. The female housing 12 is substantially in the form of a block for at least partly accommodating at least one female terminal fitting (not shown) connected with an end of a wire W2 and is fittable into the receptacle 14. A locking arm 16 is cantilevered from the upper surface of the female housing 12 and is engageable with a lock 15 in the receptacle 14 to hold the two housings 11, 12 connected. A holding arm 17 is supported at both ends at a rear part of the bottom surface of the receptacle 14, and a holding projection 18 is provided on the lower surface of the holding arm 17. Guide rails (not shown) bulge out sideways and extend forward and backward at the substantially opposite sides of the holding arm 17.

Figure 1:
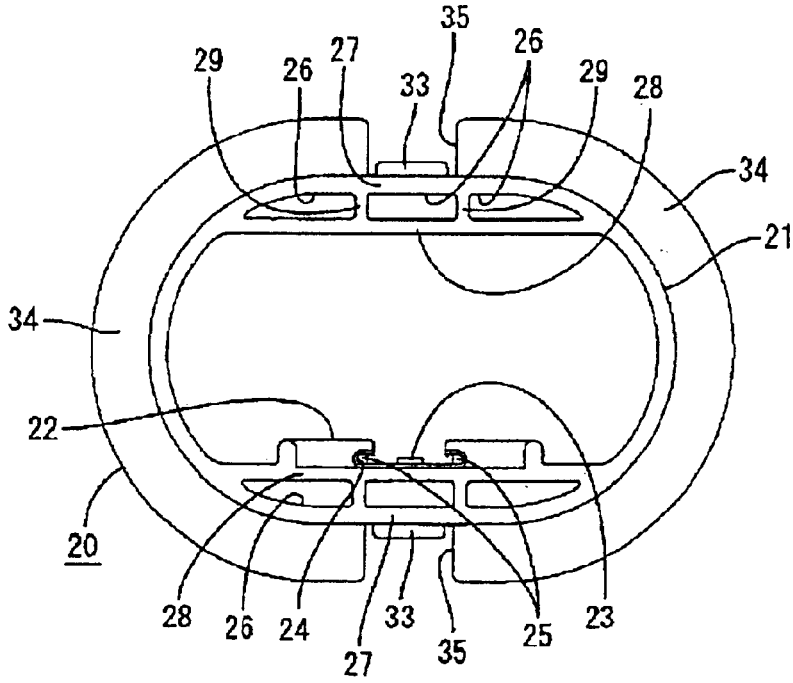
FIG. 1 is a front view of a connector holder according to a first embodiment of the invention.
Figure 2:
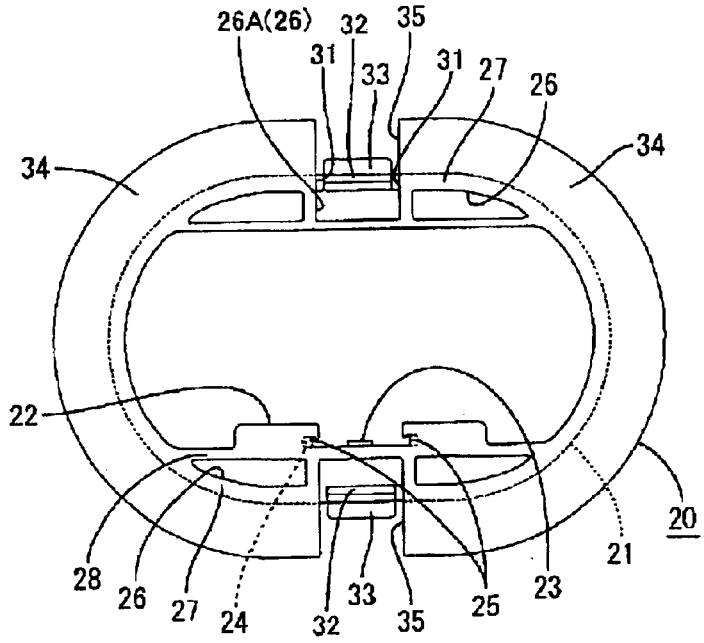
FIG. 2 is a rear view of the connector holder.

The connector holder 20 is made e.g. of a synthetic resin and is provided with a main body 21 substantially in the form of a wide oblong tube that is hollow along forward and backward directions, as shown in FIGS. 1 to 3. The connector 10 can be accommodated into the main body 21 from the front, and a connector holding portion 22 is provided on the upper inner surface of a lower part of the main body 21. A substantially widthwise middle of the connector holding portion 22 is cut away over a specified distance for receiving the holding arm 17 of the male housing 11, and a front-stop projection 23 is provided on the upper inner surface of the cut-away portion for engaging the holding projection 18 and holding the connector 10 at its front-limit position. Two guide grooves 24 are formed at the opposite edges of the cut-away portion of the connector holding portion 22 for receiving the guide rails, and a pair of back-stop projections 25 are provided at the rear ends of the guide grooves 24 for engaging the rear ends of the guide rails and holding the connector 10 at its back-limit position.

The main body 21 is substantially vertically symmetrical except the connector holding portion 22. The upper and lower parts of the main body 21 are thicker than the opposite side parts thereof, one or more, and three pairs of front and rear bores 26 open in the front and rear surfaces of the main body 21. The bores 26 are arranged in widthwise direction in each of the upper and lower parts of the main body 21 to prevent the creation of sink marks during the resin molding of the connector holder 20. The suffix A is used to the reference numeral to refer to the rear bores 26 in the middle, whereas no suffix is used when the bores 26 are mentioned collectively. Each of the upper and lower parts of the main body 21 is comprised of an outer wall 27 and an inner wall 28 and opposite sides are coupled to each other. Two longitudinal walls 29 extend substantially along forward and backward directions (FIG. 1), and a lateral wall 30 is at a longitudinal middle position and extends substantially in widthwise direction (FIG. 3). The outer and inner walls 27, 28 are coupled by the longitudinal walls 29 and the lateral wall 30.

A resiliently deformable lock arm 32 is cantilevered at substantially the widthwise middle of the rear part of each of the upper and lower outer walls 27. Each lock arm 32 is formed by a pair of slits 31 that extend from the rear end to a position near the lateral wall 30, and each lock arm 32 is vertically deformable relative to the supported front end thereof. The deformed lock arms 32 retract into the rear bores 26A and have a larger degree of inward displacement toward the rear end (see FIG. 5). Thus, the bores 26A form resilient displacement permitting spaces for the lock arms 32. The rear ends of the lock arms 32 substantially align with the rear end of the main body 21. A lock projection 33 projects out from the outer surface of each lock arm 32 and is engageable with the front edge of the mount hole H of the panel P. The lock projections 33 are at positions slightly displaced toward the front ends from the longitudinal centers of the lock arms 32, and have a width equal to the entire width of the respective lock arm 32. The lock projections 33 have slanted front surfaces that slope moderately up to the back and rear surfaces that extend substantially normal to forward and backward directions. Outer edges of the rear ends of each lock projection are chamfered.

A flange 34 bulges out at the rear end of the outer peripheral surface of the main body 21. The thickness of the flange 34 is substantially equal to the thickness of the panel P, and the flange 34 is spaced from the lock projections 33 by a specified distance. The flange 34 extends out beyond the lock arms 32, and conversely the lock arms 32 are more inward than the flange 34. Operating notches 35 are formed in portions of the flange 34 that correspond respectively to the upper and lower lock arms 32. Each operating notch 35 cuts inwardly entirely through the flange 34 and is slightly wider than the lock arm 32. Thus, the notches 35 divide the flange 34 into left and right halves, as shown in FIG. 1. The operating notches 35 ensure that the flange 34 and the lock arms 32 are at positions circumferentially displaced with respect to each other. This arrangement permits the lock arms 32 to be pressed from outside.

The connector holder 20 is used with a grommet 40 made e.g. of an elastic rubber or resilient material. The grommet 40 has an attaching portion 41 substantially in the form of a shallow box open forward and mountable in such a manner as to substantially cover the outer surface of a rear part of the connector holder 20, and a tubular portion 42 in the form of a wavy bellows through which the wire(s) W1 can be introduced.

A holding groove 43 is formed over substantially the entire inner periphery of the attaching portion 41 for engaging the flange 34 so that the grommet 40 can be attached to the connector holder 20. Areas of the attaching portion 41 corresponding to the operating notches 35 are hollow and can be pressed in from outside to deform the attaching portion 41 resiliently into the operating notches 35 (see FIG. 5)

A pressing portion 44 is defined in an area of the attaching portion 41 before the holding groove 43 and can be squeezed between the flange 34 and the panel P with the front surface of the pressing portion 44 in close contact with the rear surface of the panel P. A thin horn-shaped fringe 45 widens slightly outward over substantially the entire periphery at the front surface of the pressing portion 44, and an annular lip 46 of substantially semicircular cross-section bulges forward toward the panel P at an intermediate position. The fringe 45 and the lip 46 can be pressed and deformed against the rear surface of the panel P as the connector holder 20 is mounted onto the panel P.

The assembled connector 10 is accommodated into the connector holder 20 from front and held on the connector holding portion 22, and the attaching portion 41 of the grommet 40 is attached externally to the rear of the connector holder 20, as shown in FIG. 3. The connector holder 20 then is mounted onto the panel P. In this state, the two housings 11, 12 are accommodated in the connector holder 20 without projecting forward.

Figure 4:
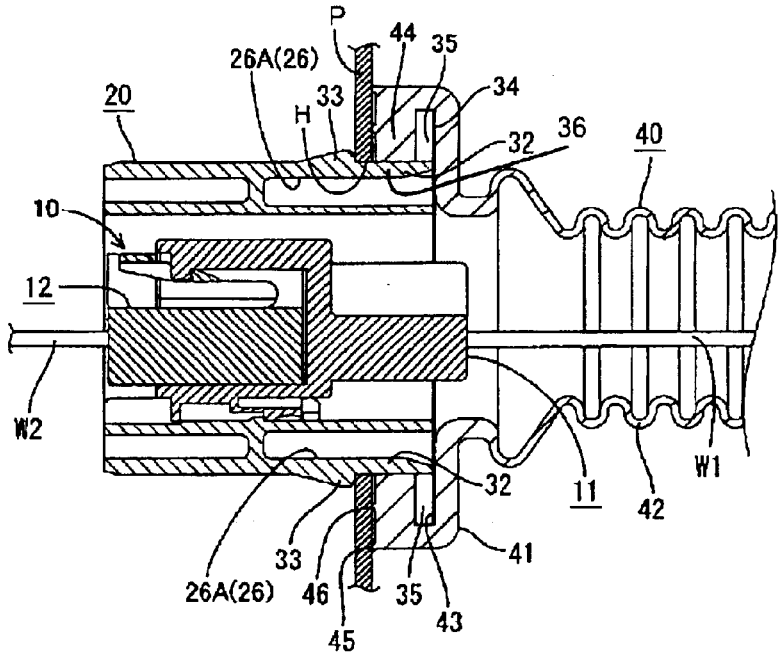
FIG. 4 is a longitudinal section showing a state where the connector holder accommodating the connector and having the grommet attached thereto is mounted on the panel.

The connector holder 20 then is inserted into the mount hole H of the panel P from the front end. As a result, the slanted surfaces of both lock projections 33 contact the rear edge of the mount hole H. The two lock projections 33 are pressed by the rear edge of the mount hole H as the connector holder 20 is pushed further and are guided by the slanted surfaces thereof. Thus, the lock arms 32 deform resiliently and retract into the bores 26A. The two lock projections 33 pass the mount hole H when the connector holder 20 is inserted to a proper depth in the mount hole H of the panel P and the lock arms 32 return resiliently so that the rear surfaces of the lock projections 33 engage the rear edge of the mount hole H, as shown in FIG. 4. In this way, the connector holder 20 is held on the panel P. The fringe 45 and the lip 46 of the grommet 40 pressed closely against the rear surface of the panel P and are deformed resiliently. The pressing portion 44 is squeezed between the flange 34 and the panel P to prevent water from entering through a clearance between the panel P and the pressing portion 44 from outside. As a result, the insides of the panel P and the connector holder 20 are sealed.

Figure 5:
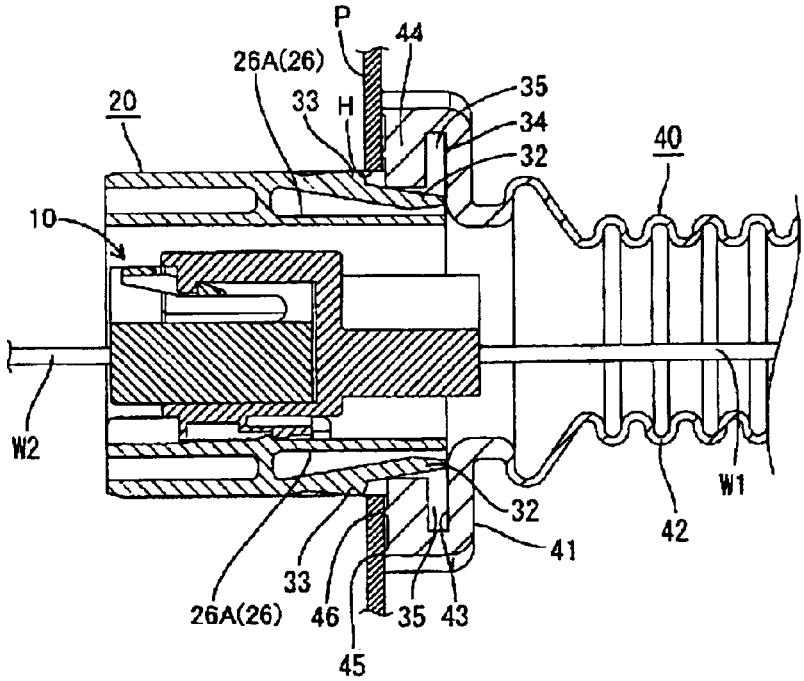
FIG. 5 is a longitudinal section showing a state where lock arms are operated via the grommet.

The connector holder 20 may have to be detached for maintenance or other reason. In such a case, the portions of the grommet 40 located at the widthwise middle of the upper and lower parts of the attaching portion 41 and substantially and aligned with the two operating notches 35 are pressed in from outside. Then, as shown in FIG. 5, the pressed portions of the attaching portion 41 are deformed resiliently and enter the operating notches 35, and operable portions 36 of the lock arms 32 that project back from the panel P are pressed in by the pressable portion 44. In this way, the lock arms 32 are deformed resiliently and retracted into the bores 26A, and the two lock projections 33 are disengaged from the front edge of the mount hole H. The connector holder 20 can be backward after the lock arms 32 are disengaged from the panel P so that the connector holder 20 and the grommet 40 can be detached from the panel P.

As described above, upon detaching the connector holder 20 from the panel P, the lock arms 32 can be displaced resiliently via the grommet 40 and disengaged from the panel P by pressing the portions of the grommet 40 corresponding to the operating notches 35 from outside. The grommet 40 need not be detached during the detaching operation. Thus, the detaching operability of the connector holder 20 from the panel P is improved.

Figure 6:
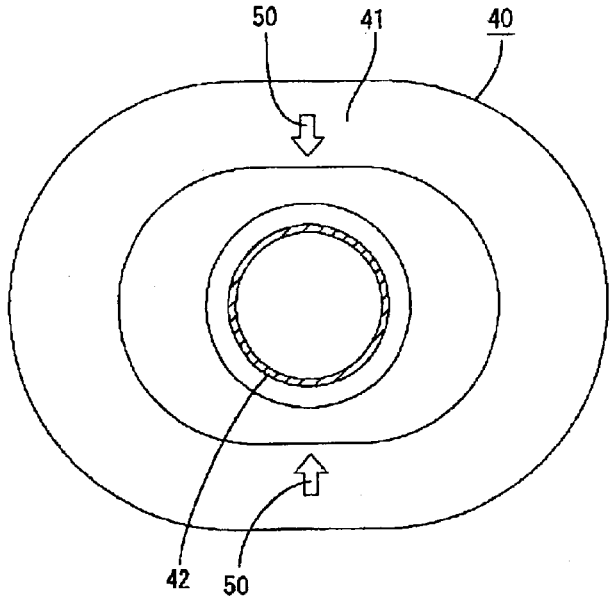
FIG. 6 is a lateral section showing a connector holder having a grommet attached thereto according to a modification of the first embodiment when viewed from behind.

A modification of the first embodiment is described with reference to FIG. 6. In this modification, marks 50 are provided to make it easier to detect the pressing portions 44 that are to be operated to detach the grommet 40. Since the other construction is similar to or the same as in the first embodiment, no repetitive description is given here.

Upper and lower marks 50 are provided on the rear surfaces of the portions of the grommet 40 located substantially at the widthwise middle of the upper and lower parts of the attaching portion 41, and hence on the rear surfaces of the grommet 40 corresponding to the operating notches 35. The marks 50 are formed, for example, by recessing, embossing and/or coloring the grommet 40, so as to be detected easily. The marks 50 can take forms other than the one shown in FIG. 6. For example, the marks 50 may be provided, for example, at the widthwise middle positions of the upper and lower surfaces of the attaching portion 41.

The connector holder 20 is detached by pressing the portions of the grommet 40 where the marks 50 are provided to deform the lock arms 32 and disengage the lock arms 32 from the panel P. The marks 50 clearly show the operator the portions of the grommet 40 that are to be operated, and hence the efficiency of detaching the connector holder 20 is improved.

A second embodiment of the invention is described with reference to FIGS. 7 to 10. In the second embodiment, operable portions 60 extend from the lock arms 32 rearward of the flange 34, instead of providing the operating notches 35 in the flange 34 as in the first embodiment. Elements of the second embodiment that are similar to or the same as elements of the first embodiment are identified by the same reference numerals, but are not described.

Figure 7:
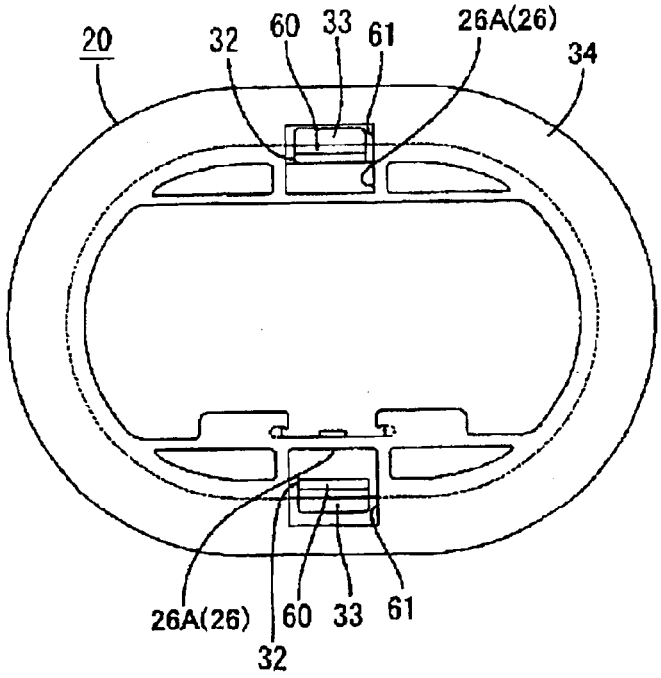
FIG. 7 is a rear view of a connector holder according to a second embodiment of the invention.
Figure 8:
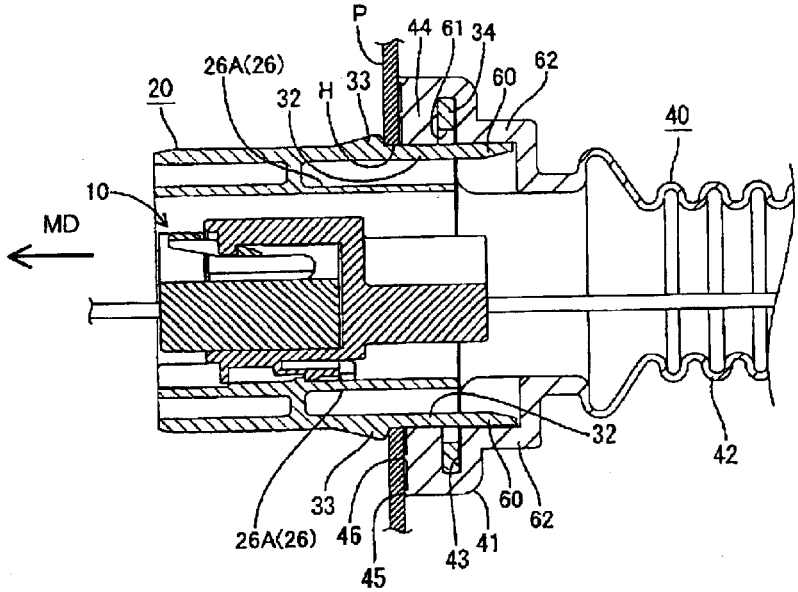
FIG. 8 is a longitudinal section showing a state where the connector holder accommodating a connector and having a grommet attached thereto is mounted on a panel.

As shown in FIGS. 7 and 8, the operable portions 60 extend from the rear ends of the lock arms 32 more backward than the rear end surface of the flange 34 at the rear end of the connector holder 20. The operable portions 60 have a width substantially equal to the entire width of the lock arms 32. The flange 34 is a substantially continuous ring that extends around the entire periphery except for mold-removal holes 61 used to withdraw molds for molding the lock projections 33. The edge of each mold-removal hole 61 faces a portion of the corresponding lock arm 32 immediately before the operable portion 60. The operable portions 60 and the flange 34 are at non-overlapping positions, and hence are displaced along forward and backward directions.

Figure 9:
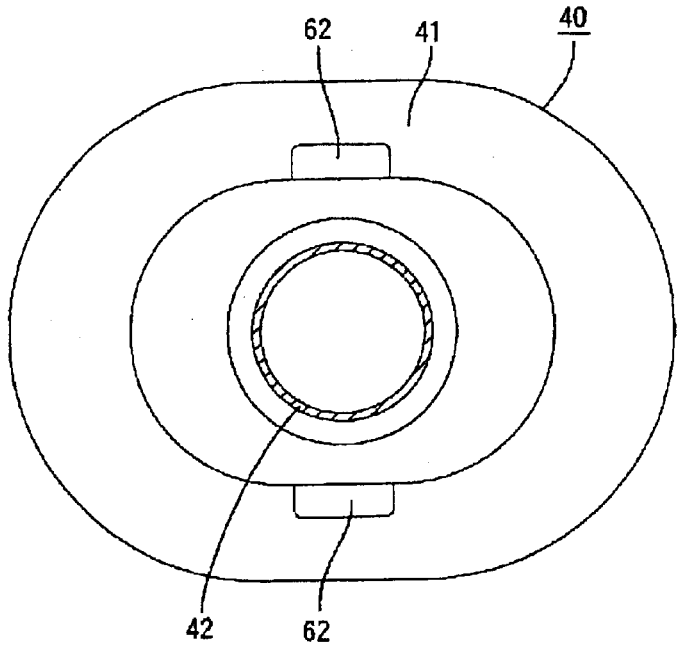
FIG. 9 is a lateral section showing the connector holder having the grommet attached thereto when viewed from behind.

As shown in FIGS. 8 and 9, escaping portions 62 for accommodating the corresponding operable portions 60 are formed at substantially widthwise middle portions of the upper and lower parts of the rear surface of the attaching portion 41 of the grommet 40 by causing these portions to bulge out backward. Each escaping portion 62 is a box substantially surrounding from outside the corresponding operable portion 60 from the outside, and the inner surface thereof is held substantially in contact with the operable portion 60. The escaping portions 62 are formed by causing the attaching portion 41 to bulge out. Thus, they can be seen easily seen from outside and function as marks for letting an operator notice portions of the grommet 40 corresponding to the operable portions 60.

Figure 10:
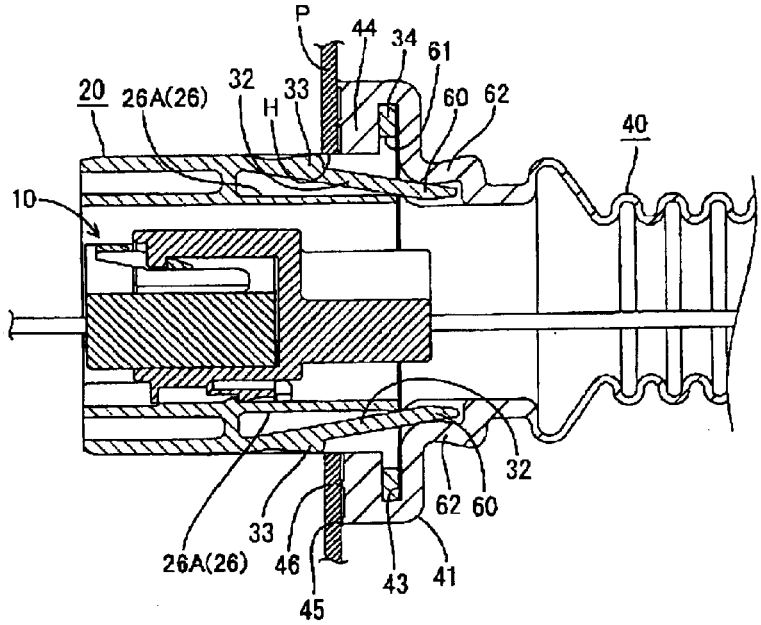
FIG. 10 is a longitudinal section showing a state where operable portions of lock arms are operated via the grommet.
Figure 11:
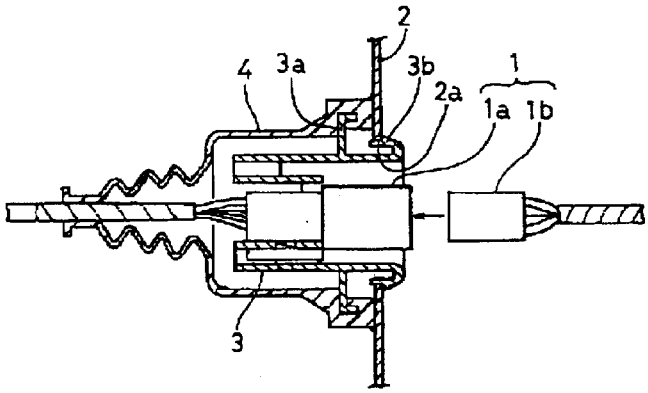
FIG. 11 PRIOR ART
FIG. 11 is a section of a prior art panel-mountable part.

Both escaping portions 62 of the grommet 40 can be pressed in, as shown in FIG. 8, to detach the connector holder from the panel P. Then, as shown in FIG. 10, these escaping portions 62 are deformed resiliently and the operable portions 60 of both lock arms 32 are pressed in by the inner surfaces of the escaping portions 62. This causes the lock arms 32 to be deformed resiliently while being retracted into the bores 26A, and the lock projections 33 disengage from the front edges of the mount hole H to cancel their locking state. Thus, the connector holder 20 can be pulled back and separated from the panel P together with the grommet 40.

As described above, the escaping portions 62 of the grommet 40 corresponding to the operable portions 60 are pressed in to displace the lock arms 32 resiliently and to cancel their locking state. The grommet 40 need not be detached during the detaching operation. Thus, the efficiency of detaching the connector holder 20 from the panel P is improved over the prior art.

The escaping portions 62 of the grommet 40 corresponding to the operable portions 60 bulge out from the attaching portion 41 and can be seen from the outside. Thus, the lock arms 32 can be displaced reliably to cancel their locking state by operating the escaping portions 62. As a result, the connector holder can be detached with improved efficiency. Moreover, the escaping portions 62 can be thinned to facilitate pressing of the operable portions 60.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

The escaping portions bulge out from the attaching portion in the second embodiment and function as marks. However, the escaping portion may bulge out over the entire periphery of an attaching portion and marks as shown in the first embodiment may be on areas of the escaping portion corresponding to operable portions to make the portions to be pressed easier to see.

A connector holder that accommodates the connector is illustrated as a panel-mountable part in the foregoing embodiments. However, only one of the housings may be a panel-mountable part with lock arms and a flange as described in the foregoing embodiments, and a grommet may be attached thereto Rear end positions of the lock arms align with the flange in the foregoing embodiments. However, they may be set at positions before the flange.

What is claimed is:

1. A panel-mountable part mountable on a panel having opposite front and rear surfaces and a mount hole extending through the panel from the front surface to the rear surface, comprising:

a grommet attachable to the panel-mountable part to substantially cover a rear side of the panel-mountable part with respect to a mounting direction on the panel and to be held substantially in close contact with the rear surface of the panel to seal the inside thereof;

a flange on at least part of an outer surface of the panel-mountable part substantially covered by the grommet for holding the grommet on the panel-mountable part, at least one lock arm projecting from the panel-mountable part and being resiliently engageable with the front side of the panel adjacent the mount hole, wherein the lock arm comprises an operable portion extending more backward than the flange with respect to the mounting direction, the lock arm being resiliently displaceable and disengaged from the panel by operating the operable portion from outside via the grommet from at least one location backward from the flange.

2. The panel-mountable part of claim 1, wherein the lock is at a position more radially inward than the flange.

3. The panel-mountable part of claim 1, wherein grommet comprises at least one escaping portion for permitting escape of the operable portion, wherein the operable portion is operated by deforming the escaping portion.

4. The panel-mountable part of claim 3, wherein the escaping portion is provided as a projection of the grommet at a circumferential position substantially corresponding to the operable portion.

5. The panel-mountable part of claim 1, wherein at least one mark detectable from outside is provided on a portion of the grommet corresponding to the operating notch and the operable portion.

6. The panel-mountable part of claim 1, wherein the pressable portion comprises projections circumferentially provided over the substantially entire circumference and configured for engaging the panel.

* * * * *